US009478370B2

(12) United States Patent
Weiss et al.

(10) Patent No.: US 9,478,370 B2
(45) Date of Patent: Oct. 25, 2016

(54) ELECTRICAL SWITCH

(71) Applicant: Johnson Electric S.A., Murten (CH)

(72) Inventors: Dirk Weiss, Altena (DE); Udo Balgheim, Hueckeswagen (DE); Martin Koepsell, Ennepetal (DE)

(73) Assignee: JOHNSON ELECTRIC S.A., Murten (CH)

( * ) Notice: Subject to any disclaimer, the term of this patent is extended or adjusted under 35 U.S.C. 154(b) by 93 days.

(21) Appl. No.: 14/297,214

(22) Filed: Jun. 5, 2014

(65) Prior Publication Data

US 2014/0360852 A1 Dec. 11, 2014

(30) Foreign Application Priority Data

Jun. 4, 2013 (DE) ..... 10 2013 009 263

(51) Int. Cl.
*H01H 9/04* (2006.01)
*H01H 9/18* (2006.01)
*H01H 23/06* (2006.01)

(52) U.S. Cl.
CPC ..... *H01H 9/18* (2013.01); *H01H 23/06* (2013.01); *H01H 9/04* (2013.01)

(58) Field of Classification Search
CPC ..... H01H 9/18; H01H 23/06; H01H 9/04
USPC ..... 200/302.1–302.3
See application file for complete search history.

(56) References Cited

U.S. PATENT DOCUMENTS 5,201,408 A * 4/1993 Torma ..... H01H 13/02 200/292
5,389,758 A * 2/1995 Agnatovech ..... H01H 13/12 200/302.2
7,964,812 B1 * 6/2011 Schwinn ..... H01H 9/04 200/302.3

FOREIGN PATENT DOCUMENTS

EP 1 581 959 B1 10/2005

* cited by examiner

*Primary Examiner* — Renee Luebke
*Assistant Examiner* — Lheiren Mae A Caroc
(74) *Attorney, Agent, or Firm* — Muncy, Geissler, Olds & Lowe PC

(57) ABSTRACT

An electrical switch for mounting into a surface of a component, has at least one shoulder region to be brought closer to this surface and which has at least one seal, which is assigned to an opening in the surface. The shoulder region has at least one region with at least one assigned indicator component, wherein this assignment is changed in terms of position in the case of complete sealing action of the seal compared to an incomplete sealing action of the seal.

15 Claims, 9 Drawing Sheets

ELECTRICAL SWITCH

CROSS REFERENCE TO RELATED APPLICATIONS

This non-provisional patent application claims priority under 35 U.S.C. §119(a) from Patent Application No. 10 201 300 9263.0 filed in Germany on Jun. 5, 2013, the entire contents of which are hereby incorporated by reference.

FIELD OF THE INVENTION

This invention relates to an electrical switch and in particular, to a switch for mounting to a surface and having a seal for sealing the switch to the surface.

BACKGROUND OF THE INVENTION

Sealed electrical switches are principally used outdoors or in industry, where they must be shielded from environmental elements, such as water, whether it be spray or pressurized water, chemicals or dust. These elements create high demands on the sealing in the switching region. The fields of use for switches of this type are very diverse and range for example from use in shipbuilding, in craft and gardening devices through to use in construction machines.

Switches of the type mentioned above are known inter alia from EP1581959B1. Here, a toggle switch is described, which has a seal, which is arranged around a bushing. The switch upper part has a spacer with projections, in order to prevent too strong a compression of the seal. The switch is suitable to be mounted into an opening located in a plate. The switch is fastened by means of a screw connection.

Defective mounting of sealed switches often leads to a loss of function of the seal. Thus, for example, the seal can be compressed too strongly or too weakly, which can lead to damage of the seal or to a reduction of the sealing function. In addition, it may occur in the case of incorrect mounting, that the switch is not permanently fastened on the installation region, as fastening elements are not completely locked for example. This is problematic to a certain extent in the case of the mounting of switches in openings of components, as the latching region is not visible and thus it is not possible to investigate correct mounting by visual inspection.

SUMMARY OF THE INVENTION

Hence there is a desire for an electrical switch of the type described at the beginning, in which a functionally suitable mounting of the switch and thus also of the seal is indicated by a noticeable optical feature.

Accordingly, in one aspect thereof, the present invention provides an electrical switch for mounting into a surface of a component, which has a shoulder region. The shoulder region has at least one region with at least one assigned indicator component, wherein this assignment is changed in terms of position in the case of complete sealing action of the seal compared to an incomplete sealing action of the seal. The indicator components give an option for investigating the correct mounting of the switch. To this end, the assignment of the indicator component to the region of the shoulder region is changed in terms of the position thereof, as soon as the seal is compressed to an extent that a complete sealing action is ensured. The indicator component can in this case be joined directly to the shoulder region or be brought close to the region of the shoulder region. The positional change of the assignment of the indicator component can for example take place in the form of breaking off, bending, penetration, displacement or the like and can in this case be reversible or else irreversible. The seal, which is assigned to the opening in the surface of the component, is preferably realized as a round seal, for example as an O-ring, or else a rectangular configuration of the seal is possible. During installation, the seal is compressed between the surface of the component and the shoulder region of the switch. This seal seals the region between the opening of the component and the switch, so that no media or contaminants can reach the interior of the component. The switch has a housing, which is sealed against environmental influences. In the region of the electrical connection lines, this seal is preferably provided by means of encapsulation with plastic. The region between the operating component and the switch housing is sealed by means of an internal seal, preferably an O-ring.

Preferably, the switch has at least one stop, which determines the minimum spacing between the lower edge of the shoulder region and the surface of the component. The stop is integrated into the switch housing in the shoulder region and is constructed as a projection. For mounting, the shoulder region is brought closer to the surface, until there is contact between the stop and the surface, wherein the spacing between the shoulder region and the surface of the component, predetermined by the stop, is slightly smaller than the provided compression height of the seal. By means of this arrangement, it is effected that the seal is compressed to the correct extent, in order on the one hand to ensure a complete sealing action by means of sufficient compression and on the other hand to prevent damage to the seal by means of too strong a compression.

In a particularly preferred development of the invention, the shoulder region has at least one indicator component, which is connected via a predetermined breaking point to the shoulder region and which is brought closer to the surface of the component in such a manner that the indicator component is changed in terms of position, preferably removed, in the case of complete sealing action of the seal. In the state, in which the switch is inserted into the opening, but has not yet been pushed down, the indicator component rests on the installation region. By bringing the shoulder region of the switch closer to the surface of the component, the seal, which can advantageously be realized as an O-ring, is compressed. When resting the stop on the surface of the component, the seal is compressed to such an extent that a complete sealing action is produced and the indicator component is changed in terms of position, in that it for example breaks off or bends at the predetermined breaking point. The indicator component is preferably installed laterally adjacently to the seal at the shoulder region and is constructed flat. The correct installation of the switch is indicated by the absence of the indicator component. Owing to the absent indicator component, the view onto a region of the switch housing or the shoulder region or the seal, which was covered by the indicator component before the installation, can also be cleared.

In a particularly preferred embodiment of the invention, the indicator component is constructed as at least one frame, which is arranged around the shoulder region of the switch and the upper edge of which is changed in terms of position with respect to the upper edge of the shoulder region, preferably is flush with the upper edge of the shoulder region, in the case of complete sealing action of the seal compared to an incomplete sealing action of the seal. A reversible variant of the indicator component is represented by this arrangement. It is provided that the frame is arranged around the opening of the component, into which the switch should be installed, and the switch is assembled into the opening through the frame. The shoulder region and the frame can be moved with respect to one another. If the shoulder region of the switch is brought closer to the surface of the installation region by pushing down the switch, then the upper edge of the shoulder region and the upper edge of the frame are displaced with respect to one another. The switch has a stop which, when resting on the surface of the component, predetermines the minimum spacing between the shoulder region of the switch and the surface of the installation region. The spacing is dimensioned in such a manner that a seal arranged between the shoulder region and the surface is compressed to a suitable extent for a complete sealing action. Preferably, the upper edge of the frame and the upper edge of the shoulder region are constructed in such a manner that the same are flush with one another in the case of a complete sealing action of the seal. The correct installation of the switch is therefore indicated by a displacement of frame and shoulder region with respect to one another.

In a further embodiment of the invention, the shoulder region has at least two depressions on the outer wall surrounded by the frame and the frame has at least one elevation on the inner surface thereof adjacent to the outer wall of the shoulder region, so that at least one elevation engages into a first depression in the case of incomplete sealing action of the seal, and that at least one elevation engages into a second depression in the case of complete sealing action of the seal. Preferably, the two depressions are arranged above one another at the edge of the shoulder region. In the non-installed state, one elevation engages on the inner surface of the frame, for example into the lower depression on the side wall of the shoulder region. If the switch is then pressed down, then the elevation on the inner surface of the frame is pushed from the lower depression into the upper depression. In order to ensure a displacement of the elevation from the lower into the upper depression, both the depression and the elevation have soundings to some extent, which are adapted to one another in terms of the shape thereof. A releasable latching is obtained owing to the partially round construction of the depression and the elevation. Thus, in this case, one is concerned with a reversible variant of the installation indicator. The correct installation of the switch is indicated by means of a change of the spacing between the upper edge of the switch and the upper edge of the frame.

Of course, the elevation may be formed on the shoulder region and the depressions formed in the frame.

In a further embodiment of the invention, the spacing between the upper edge of the shoulder region and the second depression is equal to the spacing between the upper edge of the frame and the elevation, so that the upper edge of the shoulder region is flush with the upper edge of the frame in the case of complete sealing action of the seal. A simple-to-investigate indicating feature of the correct installation is obtained, owing to the flushness of the upper edge of the shoulder region and the upper edge of the frame. In this case, the frame can for example be colored in a noticeable manner, in order to allow a simple inspection of the displacement of frame and shoulder region.

Advantageously, at least one movable visible component is assigned to the switch, which has at least one indicator component, which is constructed as a projection and the projection is assigned to at least one region of the shoulder region with a lower material thickness than the other regions of the shoulder region and the projection can penetrate this region in the case of complete sealing action of the seal, so that sections of the projection are visible. The visible components have a flat constructed region, which rests on the surface of the component, when although the switch is inserted, the seal is not compressed. The projections emanate from this flat constructed region. The visible component can be displaced with respect to the shoulder region, for example in the perpendicular direction to the surface of the component. The projections of the visible component, which are assigned to the regions with lower material thickness of the shoulder region, are advantageously constructed in a tapered manner. During the compression of the seal, for example by pressing down the switch, the assigned projections penetrate the thin regions of the shoulder region. The penetrated regions of the shoulder region therefore clear the view onto the preferably noticeably colored projection of the visible component. In the case of correct mounting, a visible and lasting feature is obtained, which indicates the sealing action of the seal. Alternatively to the pointed embodiment of the projections, the projections can also be shaped in such a manner that the same are inserted into the surface of the shoulder region after the penetration of the assigned region on the shoulder region. The shoulder region then has a smooth, planar surface. The correct installation is indicated by colored regions on the surface. An additional indicator component can also be obtained, in that the region on the shoulder region, which is assigned to the projections of the spacer, only has a lower material thickness than the remaining shoulder region at the edge. A molding is surrounded by this edge, which is removed during the penetration of the shoulder region by the projections of the spacer. The pressed out molding is proof for the correct installation of the switch, thus it functions as a checking component.

In an alternative embodiment of the invention, the indicator component and the seal are realized as one piece and the sealing region of the part is obtained by means of at least one flexible elevation, to which a depression is assigned in the shoulder region. In this case, a projection of the part is assigned to a region of lower material thickness of the shoulder region. The projection can be configured in a pointed manner, so that when inserting the switch into the opening of the component, the region of low material thickness on the shoulder is penetrated by the projection and so correct mounting is indicated. The sealing region can be obtained by means of resilient projections, which are brought closer to one or a plurality of depressions of the shoulder region. When inserting the switch into the opening of the component, the projections of the part can be compressed by the shoulder region, so that the same have a sealing action. Preferably, polyethylene with a high density (HDPE) is used as material for the part.

In a further embodiment of the invention, the seal has at least one elevation, which is assigned to at least one indicator component on the shoulder region, wherein the indicator component is connected via a predetermined breaking point to the shoulder region and the elevation is brought closer to the indicator component in such a manner that the indicator component is changed in terms of position in the case of complete sealing action of the seal. The seal has two regions, one region with sealing function, which is assigned to the shoulder region of the switch, and one region, which is constructed as a projection, which is assigned to an indicator component on the shoulder region. When the sealing region is compressed to such an extent that a sealing function results, the indicator component on the shoulder region is pressed against the projection and thus removed, for example. The correct mounting of the switch is therefore indicated for example by means of the absence of the indicator component.

To simplify the switch mounting, in a design development, the shoulder region and the seal can be constructed as one piece and the piece can have at least one indicator component connected to the part by means of a predetermined breaking point and the indicator component can be brought closer to the surface of the component in such a manner that the same is changed in terms of position in the case of complete sealing action of the seal. In the state, in which the switch is inserted into the opening of the component, but the seal is not yet compressed, the indicator component and the sealing region of the part rest on the surface of the component, whereas the remaining regions of the part do not yet have contact to the surface. By means of further approaching of the part to the surface of the component, the seal is compressed and the indicator component is removed, bent or otherwise changed in terms of position at the predetermined breaking point provided therefor. The strength of the compression of the seal is in this case determined by the non-sealing regions of the part, which therefore function as a stop. When the same rest on the surface of the component, the correct strength of the compression of the seal is reached.

A reversible variant of the installation indicator is obtained in that the seal has at least one projection, which is assigned to at least one opening in the shoulder region of the switch, so that the projection is visible from the outside in the case of complete sealing action of the seal. In the case of correct mounting of the switch, the seal is therefore sufficiently strongly compressed, the projection on the seal passes through the openings in the shoulder region of the switch and thus becomes visible from outside. The penetration of the preferably noticeably colored projection is an indicator for the correct installation of the switch. In this embodiment of the invention, the indicator component is restored to the original state thereof during the disassembly of the switch. It is also possible, depending on the fastening method, to install and disassemble the switch multiple times without losing the possibility of indicating the correct installation.

Preferably, the switch has at least one snap-fit connection. Preferably, two or more snap-fit connectors are used. The snap-fit connectors are arranged laterally on the switch housing and are flexibly designed. The clamping lengths of the snap-fit connectors are dimensioned such that the same can only engage below the surface of the installation region if the seal, for example an O-ring is compressed in terms of height. When the seal has been compressed to a satisfactory extent, the snap-fit connectors engage and the switch is correctly mounted. As the satisfactory compression of the seal is indicated by indicator components, these indicator components are also a hint as to the correct engagement of the snap-fit connectors. Installation regions of the surface of components can have different thicknesses. The same can be adapted to the clamping lengths of the snap-fit connectors by spacers with different thicknesses. The mounting by means of snap-fit connections is particularly time-saving, as the switch only has to be inserted into an opening of the component and pressed down until the snap-fit connections engage. In addition, no tools are required for mounting. The mounting of the switch using snap-fit connections is a very durable fastening, as an independent release of the connection is virtually excluded. A force is exerted by the snap-fit connections, which acts perpendicularly to the surface of the installation region of the component. Advantageously, the snap-fit connectors are arranged in such a manner in this case that the line of action of the force thereof runs through the center of the cross section of the seal. Thus, an optimal distribution and utilization of the force is achieved, which leads to a best-possible sealing action of the seal. By adding further snap-fit connections, the force distribution to the seal can be optimized further.

In a development of the invention, it is provided that the snap-fit connections are arranged in groups and the snap-fit connections in the groups have different clamping lengths from one another. Switches can be mounted in installation regions of different thickness by means of these arrangements. In each group, the snap-fit connection engages with the appropriate clamping length for the installation region in each case on the underside of the installation region. For secure mounting, the clamping length is to be chosen to be as short as possible in this case.

An alternative fastening method for the switch is obtained in that the switch has at least one thread and at least one nut, wherein the nut is arranged on the opposite side of the surface of the component to the seal. For mounting, a spacer can be laid below the shoulder region of the switch and the switch can be screwed from below using the nut.

In a development of the invention, at least one movable visible component and the shoulder region are constructed in such a manner that when assigning the two components to one another, the movable visible component and the shoulder region constitute a lateral boundary in each case and thus a groove is formed, which is suitable to accommodate the seal. In one exemplary embodiment, a lateral boundary facing the opening is represented by the shoulder region of the switch and a lateral boundary facing away from the opening is represented by the spacer. A lateral slipping of the seal, which can for example be constructed as an O-ring, is excluded by the groove formed. An optimal force action of the connecting pieces on the seal results due to the lateral fixing of the O-ring and the corresponding arrangement of the snap-fit connections.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
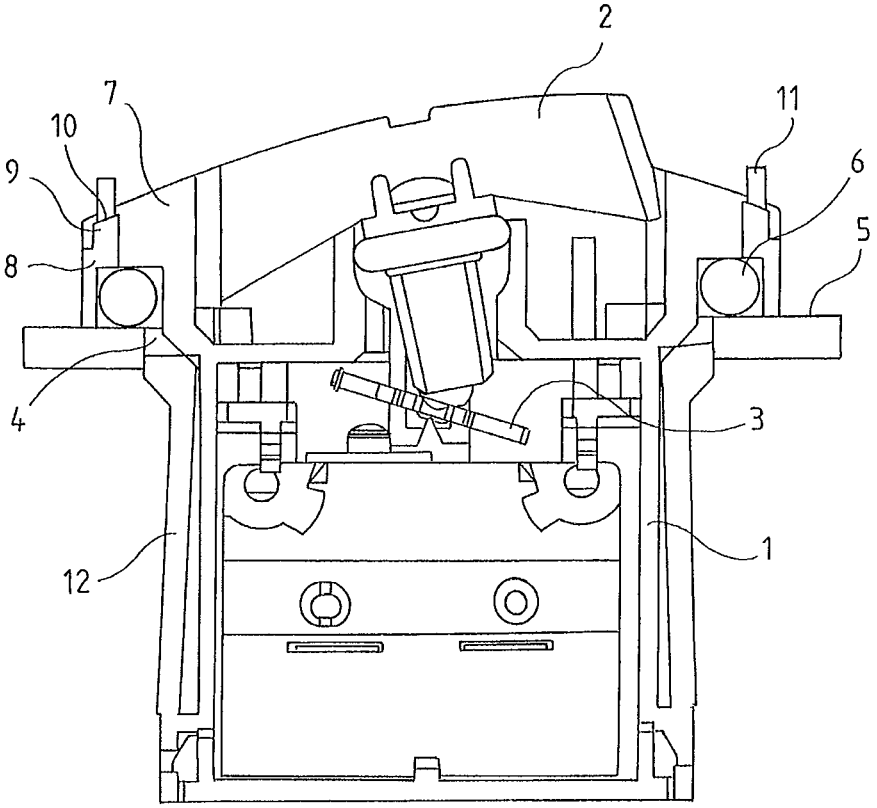
FIG. 1 is a partially cutaway view of an inserted electrical switch.

Illustrated in FIG. 1 is an electrical switch, which has at least one switch housing 1 and an actuating unit 2. A haptic component 3 is controlled between two positions by means of the actuating unit 2. It is provided that the electrical switch is mounted into the opening 4 of a surface 5 of a component. A seal 6 is arranged around the opening 4. The switch housing 1 has a shoulder region 7, which is brought closer to the seal 6. By pressing down the switch in the direction of the surface 5, a compression of the seal 6 results between the shoulder region 7 and the surface of the component 5. A movable visible component 8 is assigned to the shoulder region 7. The visible component 8 is pushed into the shoulder region 7 of the switch housing 1 in a direction opposite the mounting direction of the switch, when it makes contact with the surface 5. The visible component 8 may have projections 9 in this case, which are assigned to regions 10 on the shoulder region 7, wherein these regions have a lower material thickness than the remaining regions of the shoulder region. An indicator component 11 is located in the center of these regions 10. In the case of compression of the seal 6 by means of pressure on the shoulder region 7, the projections 9 are brought closer to the indicator components 11 in such a manner that the same are pushed out. By means of this pressure on the shoulder region 7 and the optimal travel, the snap-fit connectors 12, which are connected to the switch housing 1 at the lower end of the same, engage below the surface 5 of the component.

Figure 1A:
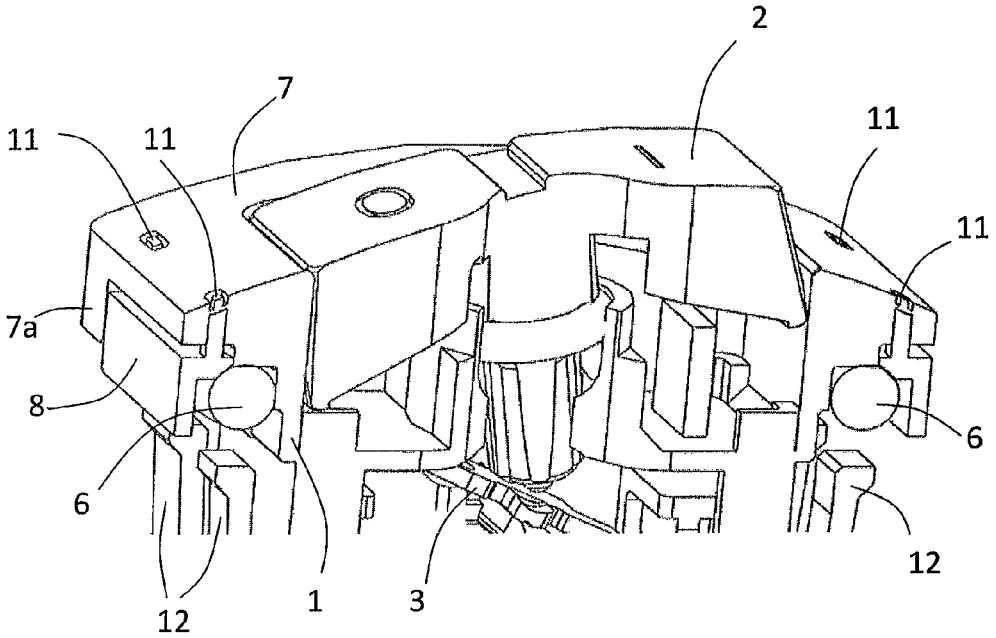
FIG. 1*a* is a partially cutaway, perspective view of a non-installed switch according to FIG. 1.

An electrical switch according to FIG. 1 is illustrated in FIG. 1*a* in the non-installed state. In order to prevent too strong a compression of the seal 6, the switch has a stop 7*a*, which is integrated into the shoulder region 7. The stop 7*a* determines the optimum travel, which is required for pressing in the switch through the opening 4 as far as the surface 5 and indicates the minimum spacing between the shoulder region 7 and the surface 5. The minimum spacing between the shoulder region 7 and the surface 5 is dimensioned in such a manner in this case, that the seal 6 is compressed strongly enough, in order to achieve a complete sealing action, but is not compressed too strongly, in order to prevent damage.

Figure 1B:
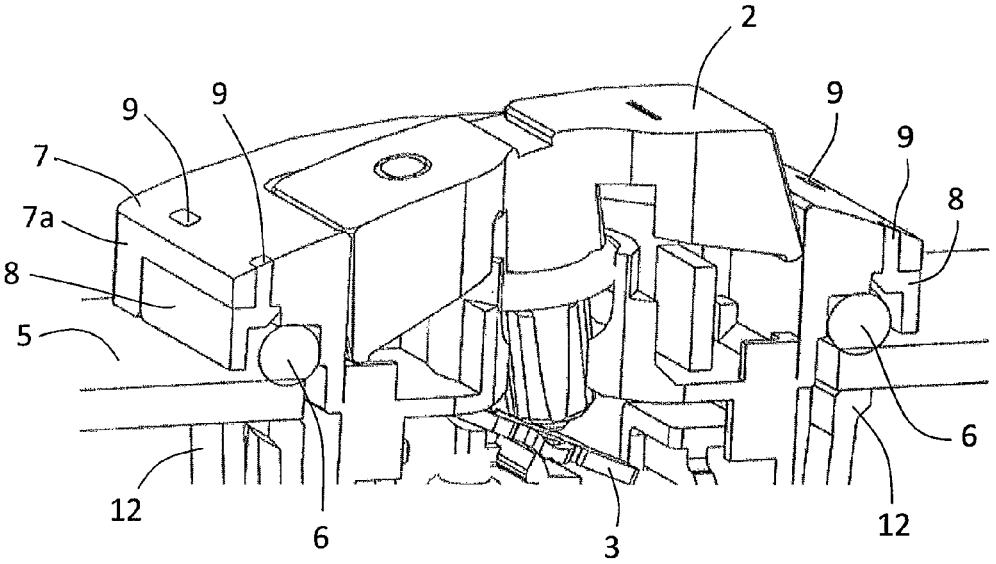
FIG. 1*b* is a partially cutaway, perspective view of an installed switch according to FIG. 1.

An electrical switch according to FIG. 1 is illustrated in FIG. 1*b* in the installed state. The stop 7*a* rests on the surface 5 of the component. The projections 9 of the movable visible component 8 have penetrated the regions 10 of the shoulder region 7 and can be seen on the surface of the shoulder region 7 as colored regions, for example. The indicator components 11 have been removed by means of the penetration of the regions 10. A correct installation of the switch is indicated by the indicator components 11, which have broken out, and the visible projections 9.

Figure 2:
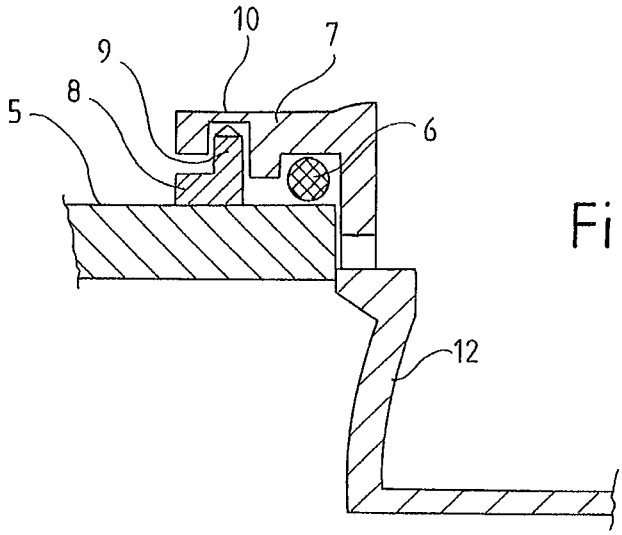
FIG. 2 is a cutaway view of a first exemplary embodiment of an electrical switch.

An exemplary embodiment is shown in FIG. 2, in which the projection 9 of the visible component 8 functions as indicator component. As in the case of the exemplary embodiment according to FIG. 1, during compression of the seal 6, the projection of the spacer is pressed through a region 10 of lower material thickness of the shoulder region 7. The indication of the correct installation of the switch is obtained by means of the penetration of the preferably noticeably colored projection 9.

Figure 3:
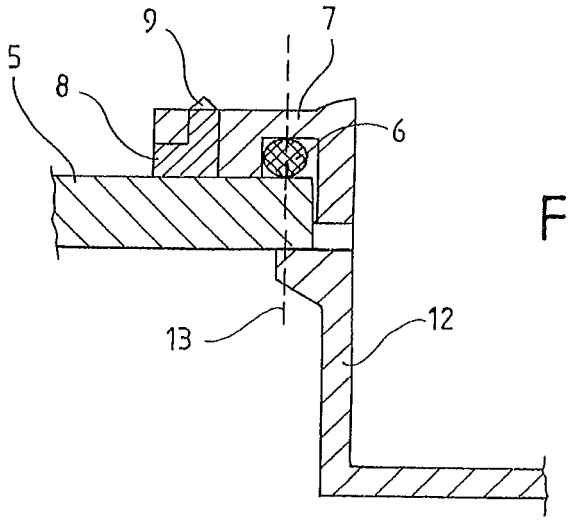
FIG. 3 is a cutaway view of an electrical switch according to FIG. 2 in the installed state.

In FIG. 3, the exemplary embodiment according to FIG. 2 is illustrated in the completely installed state. The correct installation is indicated by the protruding projection 9. The seal 6 is compressed to the correct extent and the snap-fit connectors 12 are engaged below the surface 5 of the component. The line of action of the force 13 shows that the force, which is applied by the snap-fit connectors 12, acts perpendicularly to the surface 5 of the component. In this case, the line of action of the force 13 passes through the center point of the cross section of the seal 6. Thus, an optimum distribution of the force onto the seal 6 is obtained by means of the snap-fit connectors 12.

Figure 4:
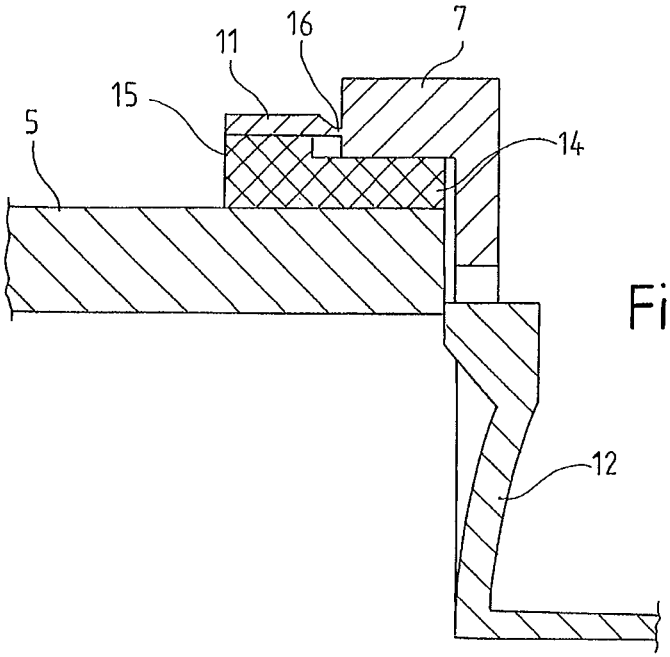
FIG. 4 is a cutaway view of a further exemplary embodiment of an electrical switch.

A further exemplary embodiment of the invention is illustrated in FIG. 4. In this exemplary embodiment, the spacer and the seal are constructed as one part 14. The part 14 has an elevation 15, which is brought closer to an indicator component 11. The indicator component 11 is connected via a predetermined breaking point 16 to the shoulder region 7 of the switch. By means of compression of the sealing region of the part 14, the elevation 15 is brought closer to the indicator component 11 in such a manner that the indicator component 11 is removed at the predetermined breaking point 16.

Figure 5:
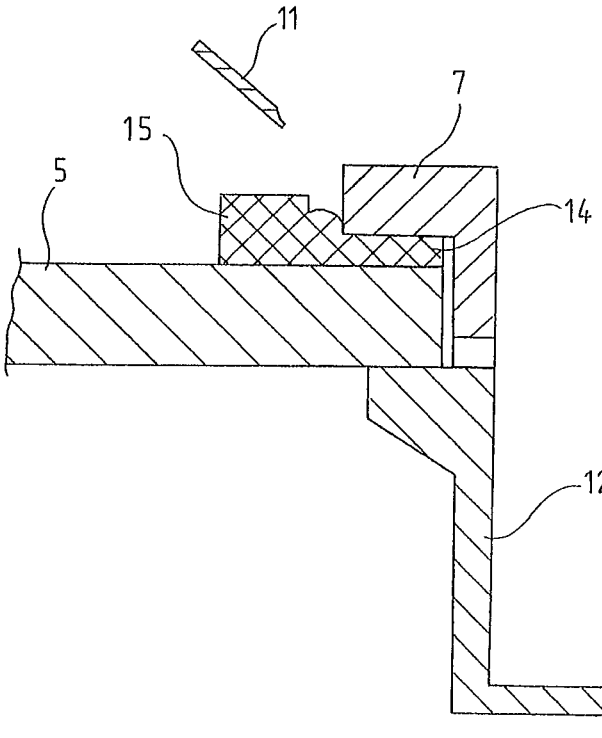
FIG. 5 is a cutaway view of an electrical switch according to FIG. 3 in the installed state.

The exemplary embodiment according to FIG. 4 is illustrated in FIG. 5 in the installed state. The sealing region of the part 14 is compressed and the snap-fit connectors 12 are engaged below the surface 5 of the component. By bringing the elevation 15 closer to the indicator component 11, the same was removed from the shoulder region 7 at the predetermined breaking point 16.

Figure 6:
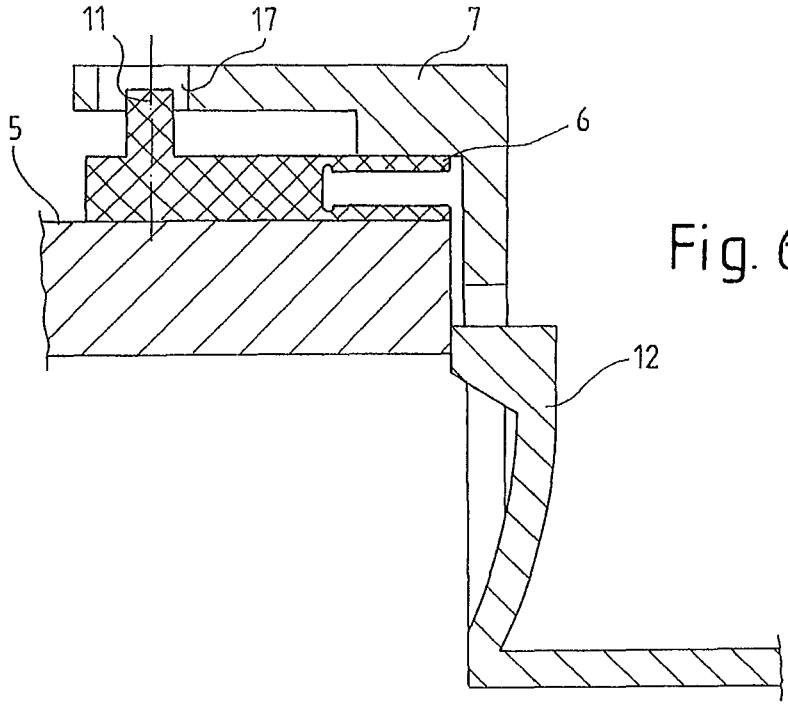
FIG. 6 is a cutaway view of a further exemplary embodiment of an electrical switch.

FIG. 6 shows an exemplary embodiment of the invention, in which the indication by means of the indicator component is reversible. The seal 6 has an elevation 11, which is assigned to an opening 17 in the shoulder region 7 of the switch. The state, in which the seal 6 has not yet been compressed and the snap-fit connectors 12 are not engaged, is illustrated.

Figure 7:
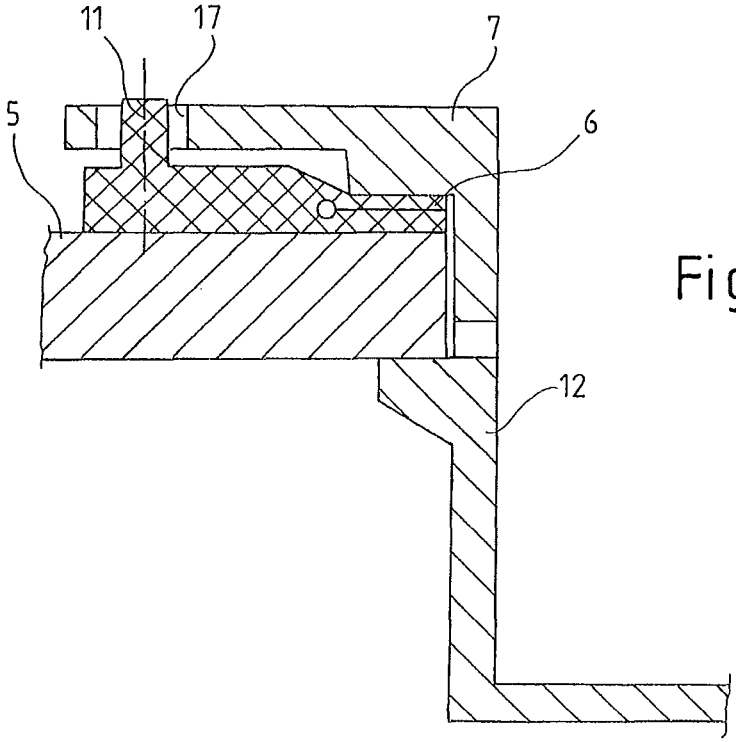
FIG. 7 is a cutaway view of an electrical switch according to FIG. 6 in the installed state.

An exemplary embodiment of the invention according to FIG. 6 is illustrated in FIG. 7 in the installed state. By means of the compression of the seal 6, the projection 11 is passed through the opening 17 of the shoulder region 7. The correct mounting of the switch is indicated by the visibility of the preferably noticeably colored projection 11. This indication can be reversed by uninstalling the switch.

Figure 8:
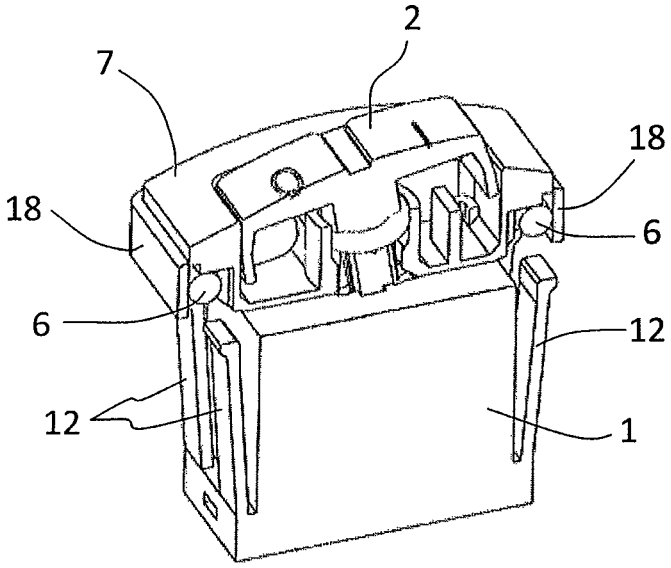
FIG. 8 is a partially cutaway, perspective view of a further exemplary embodiment of an electrical switch.

An exemplary embodiment of the invention is illustrated in FIG. 8, in which the indicator component is illustrated as a movable frame 18. The frame 18 is arranged movably around the shoulder region 7 of the switch. In this case, the frame 18 can be displaced along the outer edge of the shoulder region 7. The seal 6 is arranged between the shoulder region 7 and the frame 18.

Figure 9:
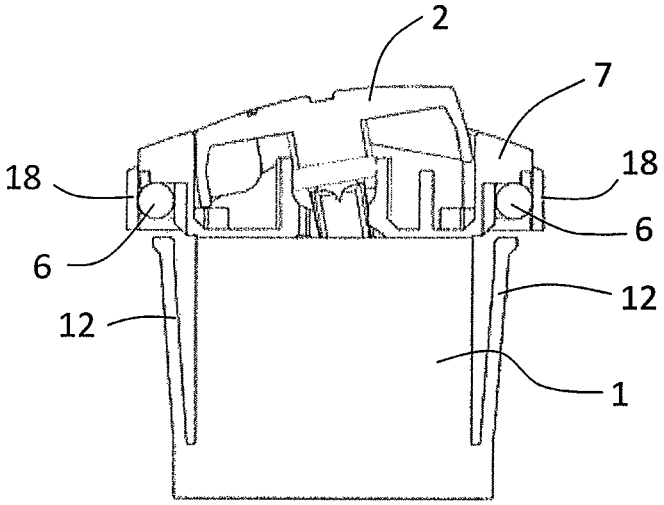
FIG. 9 is a cutaway, schematic view of an electrical switch according to FIG. 8 in the non-installed state.

An exemplary embodiment of the invention according to FIG. 8 is illustrated in FIG. 9 in the non-installed state. In the non-installed state, the frame 18 rests on the surface of the component. By bringing the shoulder region 7 closer to the surface of the component, for example by pressing down, the frame 18 and the shoulder region 7 are displaced towards one another.

Figure 10:
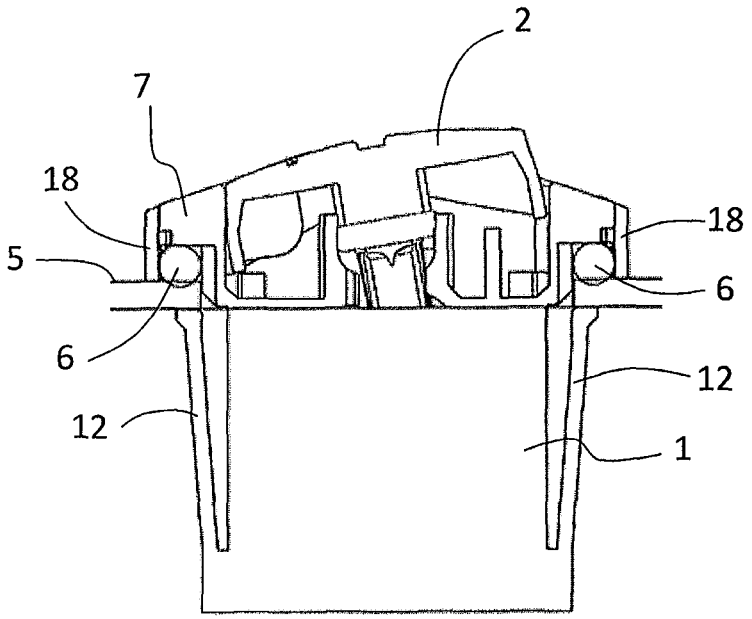
FIG. 10 is a cutaway, schematic view of an electrical switch according to FIG. 8 in the installed state.

An exemplary embodiment of the electrical switch according to FIG. 8 is illustrated in FIG. 10 in the installed state. The shoulder region 7 of the switch is brought closer to the surface 5 of the component. The seal 6 is compressed, so that a complete sealing action is obtained. The snap-fit connectors 12 are engaged below the surface 5. By bringing the shoulder region 7 closer to the surface 5, the shoulder region 7 was displaced with respect to the frame 18. The extent of the displacement between the frame 18 and the upper edge of the shoulder region 7 is dimensioned such that the upper edge of the frame 18 and the upper edge of the shoulder region 7 are flush when the switch is brought close enough to the surface, so that the snap-fit connectors 12 engage. The correct installation of the switch is therefore indicated by means of the flushness of the upper edge of the frame 18 with the upper edge of the shoulder region 7.

Figure 11:
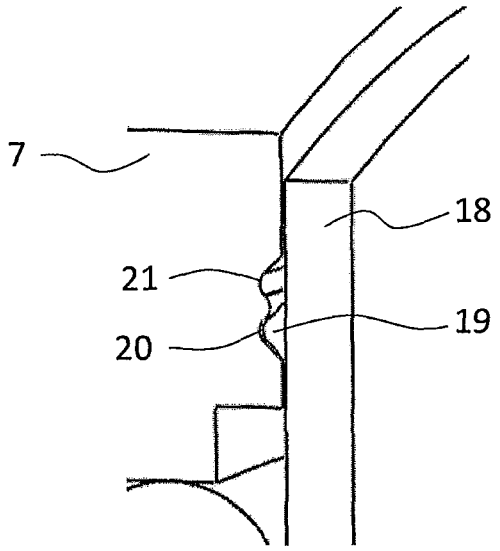
FIG. 11 is a schematic view of a latching region according to the exemplary embodiment according to FIG. 8 in the non-installed state.

A detail view of the engagement between the frame 18 and the shoulder region 7 is illustrated in FIG. 11 in the non-installed state. The projection 19 on the interior of the frame 18 engages into a first depression 20 on the exterior of the shoulder region 7. A second depression 21 is arranged above the depression 20. The upper edges of the shoulder region 7 and the frame 18 form a step.

Figure 12:
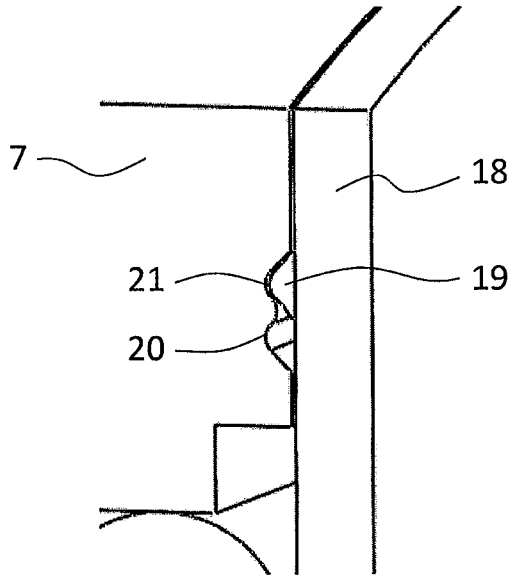
FIG. 12 is a schematic view of a latching region according to the exemplary embodiment according to FIG. 8 in the installed state.

A detail view of the engagement according to FIG. 11 is illustrated in FIG. 12 in the installed state. The projection 19 of the frame 18 engages into the second depression 21 of the shoulder region 7. In this case, the spacing between the depression 21 and the upper edge of the shoulder region 7 is equal to the spacing between the projection 19 and the upper edge of the frame 18. Thus, the upper edge of the frame 18 and the upper edge of the shoulder region 7 are flush with one another in the installed state.

Figure 13:
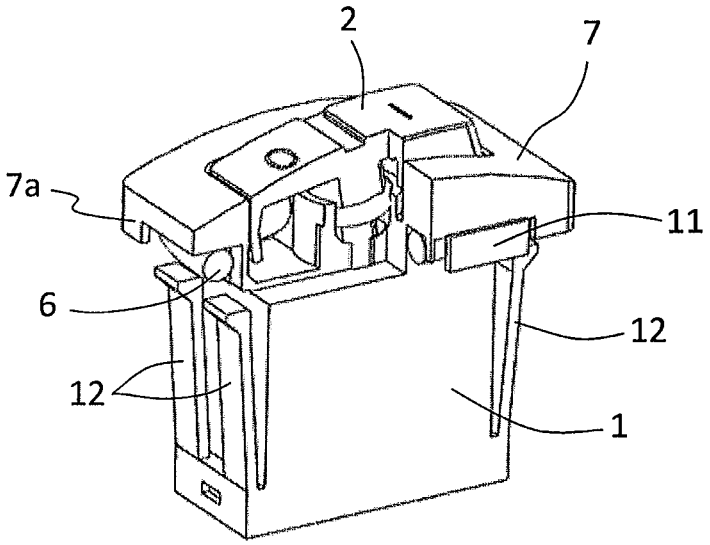
FIG. 13 is a partially cutaway, perspective view of a further exemplary embodiment of an electrical switch in the non-installed state.

FIG. 13 shows a further exemplary embodiment of the invention in the non-installed state, in which the indicator component 11 is connected to the shoulder region 7 by means of a predetermined breaking point. The indicator component 11 is dimensioned in such a manner in this case, that the same rests on the surface of a component when the switch is inserted into the opening of a component, but the seal 6 is not yet compressed. If the shoulder region 7 is brought closer to a surface of a component, then the indicator component 11 is removed by means of breaking off, bending or the like when the seal 6 is compressed to a satisfactory extent and the snap-fit connectors 12 are engaged below the surface of the installation region. The maximum compression of the seal is predetermined by a stop 7*a*. If the stop 7*a* rests on the surface of a component, then it is not possible to bring the shoulder region 7 even closer to the surface.

Figure 14:
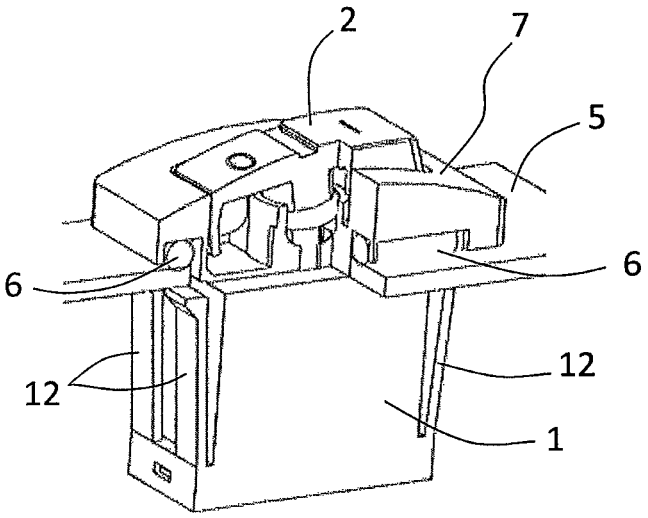
FIG. 14 is a partially cutaway, perspective view of a switch according to the exemplary embodiment according to FIG. 13 in the installed state.

An exemplary embodiment of the invention according to FIG. 13 is illustrated in FIG. 14 in the installed state. The indicator component 11 was removed by bringing the shoulder region 7 closer to the surface 5 of a component. Owing to the absence of the indicator component 11, the view onto a region of the seal 6 is cleared. The correct installation of the switch is indicated by means of this optical feature.

Figure 15:
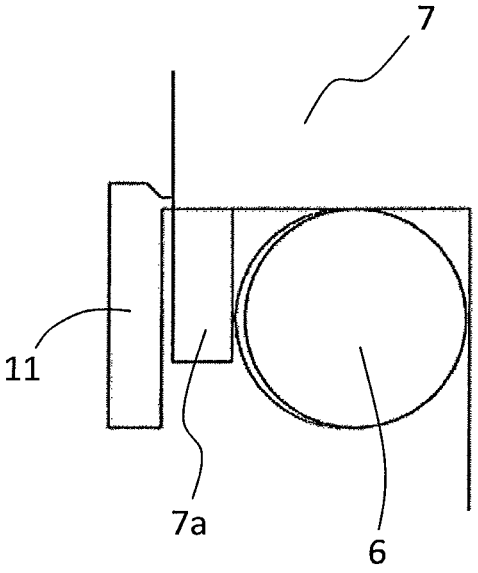
FIG. 15 is a schematic detail view of the arrangement of the indicator component according to FIG. 13.

The arrangement of the indicator component 11, the stop 7*a*, the seal 6 and the shoulder region 7 is schematically illustrated in FIG. 15 in a detail view. The stop 7*a* predetermines the extent of the compression of the seal 6 between the surface of a component and the shoulder region 7. The indicator component 11 is connected to the shoulder region 7 by means of a predetermined breaking point. If the strength of the compression predetermined by the stop 7*a* is reached for example by pressing down the switch of the seal 6, then the indicator component 11 is removed.

All of the features mentioned in the above description and in the claims can be combined in any desired selection with the features of the independent claim. The disclosure of the invention is therefore not limited to the described or claimed feature combinations, rather all sensible feature combinations in the context of the invention are to be considered as disclosed. Also, the scope of the invention is to be determined by reference to the claims that follow.

In the description and claims of the present application, each of the verbs comprise, include, contain and have, and variations thereof, are used in an inclusive sense, to specify the presence of the stated item but not to exclude the presence of additional items.

The invention claimed is:

1. An electrical switch for mounting into a surface of a component, which has at least one shoulder region to be brought closer to this surface and which has at least one seal which is assigned to an opening in the surface, wherein the shoulder region has at least one region with at least one assigned indicator component, wherein this assignment is changed in terms of position in the case of complete sealing action of the seal compared to an incomplete sealing action of the seal;

wherein the switch has at least one stop, which determines the minimum spacing between the lower edge of the shoulder region and the surface of the component; and wherein the shoulder region has at least one indicator component, which is connected via a predetermined breaking point to the shoulder region and which is brought closer to the surface of the component in such a manner that the indicator component is separated from the shoulder region in the case of complete sealing action of the seal.

2. The switch of claim 1, wherein the switch has at least one thread and at least one nut, wherein the nut is arranged on the opposite side of the surface of the component to the seal.

3. The switch of claim 1, wherein the at least one seal is partly received into the shoulder region.

4. The switch of claim 1, wherein the at least one seal is completely disposed below the shoulder region.

5. An electrical switch for mounting into a surface of a component, which has at least one shoulder region to be brought closer to this surface and which has at least one seal which is assigned to an opening in the surface, wherein the shoulder region has at least one region with at least one assigned indicator component, wherein this assignment is changed in terms of position in the case of complete sealing action of the seal compared to an incomplete sealing action of the seal;

wherein the switch has at least one stop, which determines the minimum spacing between the lower edge of the shoulder region and the surface of the component; and wherein the indicator component is constructed as at least one frame, which is arranged around the shoulder region of the switch and an upper edge of which is changed in terms of position with respect to an upper edge of the shoulder region in the case of complete sealing action of the seal compared to an incomplete sealing action of the seal.

6. The switch of claim 5, wherein the upper edge of the at least one frame is flush with the upper edge of the shoulder region in the case of complete sealing action of the seal.

7. The switch of claim 5, wherein one of the shoulder region and the frame has at least two depressions in a wall and the other of the shoulder region and the frame has at least one elevation on a surface thereof adjacent to and facing the wall, wherein at least one elevation engages into a first depression in the case of incomplete sealing action of the seal, and wherein at least one elevation engages into a second depression in the case of complete sealing action of the seal, the second depression being located at a different height from the first depression with respect to the upper edge of the shoulder region.

8. The switch of claim 7, wherein the elevation and the second depression are arranged such that the upper edge of the shoulder region is flush with the upper edge of the frame in the case of complete sealing action of the seal.

9. The switch of claim 5, wherein the seal has at least one projection, which is assigned to at least one opening in the shoulder region, and in that the projection is visible from the outside in the case of complete sealing action of the seal.

10. The switch of claim 5, wherein the switch has at least one snap-fit connection.

11. The switch of claim 10, wherein the snap-fit connections are arranged in groups and the snap-fit connections in the groups have different clamping lengths from one another.

12. An electrical switch for mounting into a surface of a component, which has at least one shoulder region to be brought closer to this surface and which has at least one seal which is assigned to an opening in the surface, wherein the shoulder region has at least one region with at least one assigned indicator component, wherein this assignment is changed in terms of position in the case of complete sealing action of the seal compared to an incomplete sealing action of the seal;

wherein the switch has at least one stop, which determines the minimum spacing between the lower edge of the shoulder region and the surface of the component; and wherein the seal has at least one elevation, which is assigned to at least one indicator component of the shoulder region, wherein the indicator component is connected via a predetermined breaking point to the shoulder region and the elevation is brought closer to the indicator component in such a manner that the indicator component is changed in terms of position in the case of complete sealing action of the seal.

13. An electrical switch for mounting into a surface of a component, which has at least one shoulder region to be brought closer to this surface and which has at least one seal which is assigned to an opening in the surface, wherein the shoulder region has at least one region with at least one assigned indicator component, wherein this assignment is changed in terms of position in the case of complete sealing action of the seal compared to an incomplete sealing action of the seal, wherein the switch has at least one stop, which determines the minimum spacing between the lower edge of the shoulder region and the surface of the component, wherein the shoulder region and the seal are constructed as one piece and the piece has at least one indicator component connected to the piece by means of a predetermined breaking point, and wherein the indicator component is brought closer to the surface of the component in such a manner that the same is changed in terms of position in the case of complete sealing action of the seal.

14. An electrical switch for mounting into a surface of a component, which has at least one shoulder region to be brought closer to this surface and which has at least one seal which is assigned to an opening in the surface, wherein the shoulder region has at least one region with at least one assigned indicator component, wherein this assignment is changed in terms of position in the case of complete sealing action of the seal compared to an incomplete sealing action of the seal;

wherein the switch has at least one stop, which determines the minimum spacing between the lower edge of the shoulder region and the surface of the component;

wherein at least one movable visible component is assigned to the switch, which has at least one indicator component, which is constructed as a projection and the projection is assigned to at least one region of the shoulder region with a lower material thickness than the other regions of the shoulder region and the projection penetrates this region in the case of complete sealing action of the seal, so that sections of the projection are visible; and wherein at least one movable visible component and the shoulder region are constructed in such a manner that when assigning the two components to one another, the movable visible component and the shoulder region constitute a lateral boundary in each case and form a groove to accommodate the seal.

15. The switch of claim 14, wherein the indicator component and the seal are realized as one piece and in that the sealing region of the piece is obtained by means of at least one flexible elevation, to which a depression is assigned in the shoulder region.

* * * * *